United States Patent [19]

Law et al.

[11] Patent Number: 4,961,905

[45] Date of Patent: Oct. 9, 1990

[54] NICKEL ALUMINIDE MATERIALS HAVING TOUGHNESS AND DUCTILITY AT LOW TEMPERATURES

[75] Inventors: Chi C. Law, South Glastonbury; Scott M. Russell, East Hartford, both of Conn.

[73] Assignee: United Technologies Corporation, Hartford, Conn.

[21] Appl. No.: 283,688

[22] Filed: Dec. 13, 1988

[51] Int. Cl.[5] ..... C22C 19/00

[52] U.S. Cl. ..... 420/460; 148/429; 148/442; 420/580

[58] Field of Search ..... 148/429, 442, 402; 420/460, 580

[56] References Cited

U.S. PATENT DOCUMENTS 4,710,247 12/1987 Huang et al. ..... 420/460

*Primary Examiner*—R. Dean

*Attorney, Agent, or Firm*—Charles E. Sohl

[57] ABSTRACT

A modified class of nickel aluminide (NiAl) type material is disclosed having useful amounts of toughness and ductility at low temperatures, e.g. room temperature. The basic NiAl material is modified with an additional of the material such as cobalt which produces a structure which is susceptible to undergoing a martensitic transformation. The martensitic structure when produced results in a significant increase in toughness and ductility at low temperatures.

2 Claims, 1 Drawing Sheet

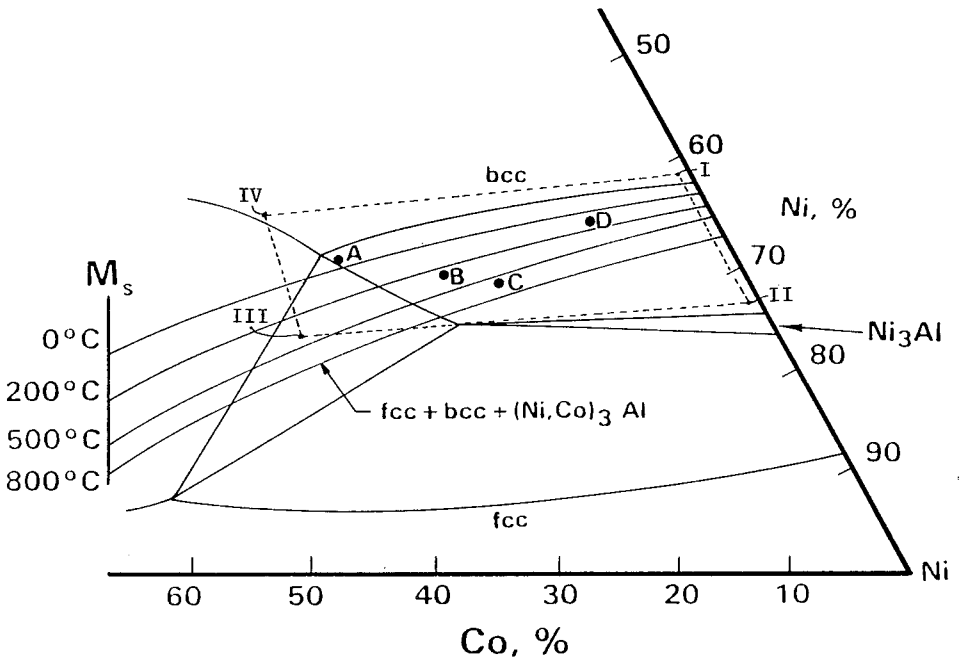
Ni, %
50
60
70
80
90
Ni
Co, %
10
20
30
40
50
60
$Ni_3Al$
I
II
III
IV
A
B
C
D
bcc
fcc
fcc + bcc + $(Ni,Co)_3Al$
$M_s$
0°C
200°C
500°C
800°C

NICKEL ALUMINIDE MATERIALS HAVING TOUGHNESS AND DUCTILITY AT LOW TEMPERATURES

The Government has rights in this invention pursuant to a contract awarded by the Department of the Air Force.

TECHNICAL FIELD

The present invention relates to intermetallics based on NiA1.

BACKGROUND ART

There is a constant demand for improved high temperature materials. Such materials are widely used, for example in gas turbine engines. One class of materials which has attracted attention for some time are the intermetallics. These are materials having specific narrow composition ranges and having, in general, an ordered structure. Typical intermetallics are $Ni_3A1$, NiA1, and TiA1. Intermetallics are interesting because they have good strength and often have very high melting points. In general, however, they suffer a lack of ductility or fracture toughness particularly at low temperatures. While such materials often have significant ductilities at temperatures above 1000° F., at room temperature they have essentially no ductility and very little fracture toughness. This means that while their high temperature properties may be attractive to the gas turbine engine designer, their lack of low temperature ductility and toughness makes their use impractical both from a standpoint of fabrication and assembly and from the standpoint that apparatus which operates at high temperatures periodically is cooled for one reason or another and is very vulnerable to failure during initial operation and during the cool down stage.

DISCLOSURE OF INVENTION Disclosure of Invention

It is an object of the invention to disclose a general method for modifying intermetallics of the NiA1 type to produce useful amounts of ductility and toughness.

It is another object of the invention to disclose a particular alloying element, cobalt, which can be added to NiAl intermetallics to improve toughness and ductility.

According to the invention NiA1 intermetallic materials are modified by adding sufficient amounts of an alloying material which renders the NiA1 structure susceptible to a martensitic transformation. The favored alloying element is cobalt. It has been found that additions of cobalt can double or triple the fracture toughness of nickel aluminide materials while simultaneously significantly increasing the room temperature yield strength.

The foregoing and other features and advantages of the present invention will become more apparent from the following description and accompanying drawing.

BRIEF DESCRIPTION OF DRAWING

The FIGURE shows a portion of the nickel cobalt uminum phase diagram illustrating the compositions interest with respect to the present invention and also illustrating schematically the effect of composition on the starting temperature for the martensitic reaction in this alloy family.

BEST MODE FOR CARRYING OUT THE INVENTION

The invention in its broadest form comprises the development of a significant amount of martensitic structure in nickel aluminum alloys with the NiAl type. We prefer to produce from about 20 to about 100 vol. % of martensite. The martensite structure may be present in the alloy upon cooling from the solidification temperature or it may be developed in the alloy subsequent to solidification and cooling by the application of stress or by further cooling below room temperature.

The FIGURE shows a portion of the nickel, cobalt, aluminum phase diagram and illustrates the composition region of the present invention. The region is defined by the points I, II, III, IV whose composition is described in the Table 1 below. All composition percents are atomic percent used herein unless otherwise noted. Preferably at least 10 atomic percent cobalt is present.

TABLE 1

| | Ni | Al | Co |
|---|---|---|---|
| I | 61 | 38 | 1 |
| II | 72 | 27 | 1 |
| III | 35 | 25 | 40 |
| IV | 27 | 35 | 38 |

Also shown on the FIGURE are lines which indicate the temperature at which the martensitic transformation starts for these materials. All materials whose martensitic start temperature is above room temperature will be transformed to martensitic, to the extent such transformation is thermodynamically faborable, upon cooling to room temperature. Of course, alloys whose martensitic start temperature is below room temperature can be cooled to cause the transformation. The martensitic transformation is diffusionless, and no extended time at temperature is required.

Table 2 below lists composition of four allous which illustrate aspects of the present invention. Also indicated in Tabe 2 is an estimate of the phase and the amounts of these phases present at room temperature.

TABLE 2

| | Composition (atom %) | | | | Transformation Temperatures (°C.) | | | |
|---|---|---|---|---|---|---|---|---|
| Alloy | Ni | Co | Al | B | As | Af | | Phase Structure at Room Temp. |
| A | 35 | 35 | 30 | | −70 | −55 | 80% | (Ni, Co)(CoAl), B2 |
| | | | | | | | 20% | fcc, most likely ordered |
| B | 44.75 | 25 | 30 | 0.25 | 175 | 210 | 95% | Ni(Al, Co), Llo Martensite |
| | | | | | | | 5% | possibly $(Ni, Co)_{20}Al_3B_6$ |
| C | 50 | 21 | 29 | | 725 | 745 | 75% | Ni(Al, Co), Llo Martensite |
| | | | | | | | 25% | $(Ni, Co)_3(Al, Co), Li_2$ |

TABLE 2-continued

| Alloy | Composition (atom %) Ni | Co | Al | B | Transformation Temperatures (°C.) As | Af | Phase Structure at Room Temp. |
|---|---|---|---|---|---|---|---|
| D | 55 | 35 | 10 | | 35 | 95 | 65% (Ni, Co)(Co, Al),B2<br>20% Ni(Al, Co), Llo Martensite<br>15% $(Ni, Co)_3(Al, Co)$, $Ll_2$ |

Note:
As is the austenite start temperature, essentially equal to Mf which is the martensite finish temperature Mf. Af is the austenite finish temperature, essentially equal to Ms which is the martensite start temperature Ms.

Alloy A contained the phases indicated at room temperature and as shown contain no martensitic structure at room temperature. However, alloy A was susceptible to formation of martensitic structure through a stress induced transformation during mechanical testing. Alloys B, C, and D did contain significant amounts of a martensitic structure of the Llo type.

TABLE 3

Comparison of NiAl with Experimental NiAl—Co Alloys

| Alloy | Composition (at. %) Ni | Al | Co | B | Room Temp. Fracture Toughness Kic (ksi) | Room Temp. Yield Strength (ksi) |
|---|---|---|---|---|---|---|
| NiAl | 50 | 50 | | | <5 | 42 |
| NiAl | 52 | 48 | | | <5 | 58 |
| 89 | 50 | 25 | 25 | | — | 80 |
| A | 35 | 30 | 35 | | 15.5 | 162 |
| B | 44.75 | 30 | 25 | 0.25 | 9.6 | 110 |
| C | 50 | 29 | 21 | | 21.9 | 115 |

Table 3 lists alloys, A, B, and C and their mechanical tests results along with two specimens of nickel aluminide without cobalt and another specimen of nickel alumnide with cobalt but outside of the present invention. It can be seen that whereas the pure nickel aluminide and the other nickel aluminide outside the scope of the invention had very low room temperature fracture toughness values, less than 5 ksi and room temperature yield strengths of less than 80 ksi, the alloys which fall within the scope of the invention had room temperature fracture toughness values in excess of 8 and room temperature yield strengths in excess of 100 ksi. Thus it appears that alloys according to the invention derive improved fracture toughness and improved yield strength from the presence of martensite. The benefits of martensite on fracture toughness and ductility are known in other intermetallic systems principally the NiTi system. However, the majority of intermetallic systems, even where martensite is present there is no significant improvement in fracture toughness or ductility.

Although this invention has been shown and described with respect to detailed embodiments thereof, it will be understood by those skilled in the art that various changes in form and detail thereof may be made without departing from the spirit and scope of the claimed invention.

We claim:

1. A composition, based on NiA1, capable of forming at least 20 vol.% of a martensitic structure, comprising:
   a composition falling within the area defined by points I, II, III and IV in the FIGURE.

2. A method for increasing the low temperature ductility and fracture toughness of NiA1 material which comprises:
   adding from 1 to 40 atomic percent cobalt to said NiA1 material.

* * * * *